US011815242B2

(12) United States Patent
Shi et al.

(10) Patent No.: US 11,815,242 B2
(45) Date of Patent: Nov. 14, 2023

(54) LIGHT GUIDE ASSEMBLY, VEHICLE LIGHT AND VEHICLE

(71) Applicant: VALEO VISION, Bobigny (FR)

(72) Inventors: Xingang Shi, Foshan (CN); Yanna Chen, Foshan (CN); Zebin Ni, Foshan (CN); Yamei Li, Foshan (CN)

(73) Assignee: Valeo Vision, Bobigny (FR)

( * ) Notice: Subject to any disclaimer, the term of this patent is extended or adjusted under 35 U.S.C. 154(b) by 0 days.

(21) Appl. No.: 17/778,062

(22) PCT Filed: Nov. 19, 2020

(86) PCT No.: PCT/CN2020/129988

§ 371 (c)(1),
(2) Date: May 19, 2022

(87) PCT Pub. No.: WO2021/098753

PCT Pub. Date: May 27, 2021

(65) Prior Publication Data

US 2023/0029287 A1 Jan. 26, 2023

(30) Foreign Application Priority Data

Nov. 22, 2019 (CN) ..... 201922049806.0

(51) Int. Cl.
*F21S 43/241* (2018.01)
*F21S 43/247* (2018.01)
(Continued)

(52) U.S. Cl.
CPC ..... *F21S 43/241* (2018.01); *F21S 43/14* (2018.01); *F21S 43/239* (2018.01);
(Continued)

(58) Field of Classification Search
CPC .... F21S 41/24; F21S 43/14; F21S 43/235–26; F21S 43/40; F21Y 2115/10
See application file for complete search history.

(56) References Cited

U.S. PATENT DOCUMENTS 9,328,891 B1 * 5/2016 Dernar ..... F21S 43/195
9,879,836 B2 1/2018 Kleiner
(Continued)

FOREIGN PATENT DOCUMENTS

CN 104459869 A 3/2015
CN 104748034 A 7/2015
(Continued)

OTHER PUBLICATIONS

ISA/CN, International Search Report (with English translation) and Written Opinion of corresponding International Application No. PCT/CN2020/129988, dated Feb. 20, 2021.

*Primary Examiner* — Jason M Han
(74) *Attorney, Agent, or Firm* — Valeo Vision

(57) ABSTRACT

The present invention relates to a light guiding assembly, a vehicle lamp and a vehicle. Specifically, the light guide assembly includes at least a first light guide element and a second light guide element, which can be joined to form a predetermined shape, in the region where the first light guide element and the second light guide element are joined, the parts of the first light guide element and the second light guide element that face each other at least partially overlap, so that light leaving one of the first light guide element and the second light guide element can at least partially enter the other. The vehicle lamp and the vehicle have the abovementioned light guide assembly.

9 Claims, 3 Drawing Sheets

(51) Int. Cl.

| | |
|---|---|
| ***F21S 43/40*** | (2018.01) |
| ***F21S 43/14*** | (2018.01) |
| ***F21S 43/239*** | (2018.01) |
| ***F21S 43/20*** | (2018.01) |
| ***F21Y 115/10*** | (2016.01) |

(52) U.S. Cl.
CPC ..... *F21S 43/247* (2018.01); *F21S 43/26* (2018.01); *F21S 43/40* (2018.01); *F21Y 2115/10* (2016.08)

(56) References Cited

U.S. PATENT DOCUMENTS

| | | | | |
|---|---|---|---|---|
| 9,933,128 | B2 * | 4/2018 | Ah | F21S 43/237 |
| 10,088,121 | B2 | 10/2018 | Ladenburger | |

FOREIGN PATENT DOCUMENTS

| | | | |
|---|---|---|---|
| CN | 105465709 | A | 4/2016 |
| CN | 110220156 | A | 9/2019 |
| CN | 211289917 | U | 8/2020 |
| JP | 2015204275 | A | 11/2015 |
| JP | 2019200937 | A | 11/2019 |

* cited by examiner

LIGHT GUIDE ASSEMBLY, VEHICLE LIGHT AND VEHICLE

CROSS-REFERENCE TO RELATED APPLICATIONS

This application is filed under 35 U.S.C. § 371 U.S. National Phase of International Application No. PCT/CN2020/129988 filed Nov. 19, 2020 (published as WO2021098753), which claims priority benefit to Chinese application No. 201922049806.0 filed on Nov. 22, 2019, the disclosures of which are herein incorporated by reference in their entirety.

TECHNICAL FIELD

The present invention relates to a light guiding assembly, a vehicle lamp and a vehicle.

BACKGROUND OF THE INVENTION

Light-emitting diodes (LEDs) are increasingly used in vehicle lamps in conjunction with light guides, for example, in signal lights to provide the desired exit light effect. Here, the desired lighting effect depends on the shape and orientation of the light guide. However, if there is a sudden change in the light guide shape, for example, if the angle formed between two adjacent sections of the light guide is a right angle or an acute angle, the lighting effect will be uneven at the portion with the sudden change relative to other parts. In addition, when the desired lighting region occupies a large area and is particularly elongated, the volume occupied by the light guide is also large, resulting in high manufacturing costs.

BRIEF SUMMARY OF THE INVENTION

The purpose of the present invention is to provide a light guide assembly, which can at least partially solve the above-mentioned technical problem.

The light guide assembly according to the present invention is implemented as split parts, i.e., the light guide assembly comprises at least a first light guide element and a second light guide element, which can be joined to form a predetermined shape, in the region where the first light guide element (201) and the second light guide element (202) are joined, the parts of the first light guide element and the second light guide element that face each other at least partially overlap, so that one light leaving the first light guide element and the second light guide element can at least partially enter the other.

In the proposed light guide assembly, the light guide assembly is implemented as split parts, i.e. the light guide assembly consists of a plurality of elements, each of which can be made separately, for example, by injection molding, which is particularly advantageous for low-cost manufacturing of large light guide assemblies or light guide assemblies with complex shapes, and also facilitates warehousing and transportation. The individual elements that form the light guide assembly can be joined together later. For example, the individual elements may be held on a bracket, thereby occupying the correct positions relative to each other. By overlapping the parts of the corresponding elements facing each other in the joined region, compared with the arrangement where the parts facing each other in the joined region are parallel surfaces, mixed light will emit at the front of the gap between the two elements in the exit direction of the light, thereby avoiding the problem of uneven exit light in the joined region relative to other regions, so as to achieve a uniform exit lighting effect on the whole.

According to the embodiments of the present invention, the light guide assembly takes an L shape or other suitable shapes in the assembled state, thereby demonstrating the desired shape.

According to the embodiments of the present invention, the first light guide element and the second light guide element are plate-shape elements with a predetermined thickness. The thickness of the plates may be set based on the desired width of the light emitting surface.

According to the embodiments of the present invention, the first light guide element and the second light guide element have stepped portions in the joined region, wherein the stepped portions of the first light guide element overlap the stepped portions of the second light guide element in the joined state. Here, "overlapping" may be understood to mean that, the projections of the stepped portions of the corresponding light guide elements at least partially overlap in a plane transverse to the light emitting direction, thereby light leaving one light guide element can enter the other light guide element in the joined region, thus ensuring uniformity of the exit light.

According to the embodiments of the present invention, the first light guide element and the second light guide element are each divided into a plurality of sections, each section having its own light coupling surface, light reflection surface and light exit surface, wherein light reaching the light reflection surface is reflected toward the light exit surface, and the light exit surface is provided with micro light diffusion structures. In this way, the light reflection surfaces arranged side by side, in particular, can be staggered in the light emitting direction in order to better adapt to the internal space of the housing of the vehicle lamp in which the light guide assembly is installed. In addition, the light is additionally aligned through the light reflection surfaces, so that light distribution is made easier before the light finally exits, thereby better controlling the exit direction of the light. The segmented light guide elements also allow for higher flexibility in the design of the associated light guide elements.

The present invention also provides a vehicle lamp, which has a light source component, a light guide assembly and a lens, wherein the light source component is assigned to the light guide assembly, the lens is disposed on the light exit side of the light guide assembly, and the light guide assembly is the light guide assembly described above.

The light source component may have a light-emitting diode. Here, one light-emitting diode may be allocated to each section of the light guide assembly.

The present invention also provides a vehicle, which has the vehicle lamp described above.

The above description of the advantages of the light guide assembly also applies to the vehicle lamp and the vehicle, and will not be repeated here.

BRIEF DESCRIPTION OF THE DRAWINGS

The present invention is further described below in conjunction with the drawings. In the drawings.

DETAILED DESCRIPTION OF THE INVENTION

Embodiments of the present invention are described demonstratively below. As those skilled in the art should realize, the embodiments explained may be amended in various ways without departing from the concept of the present invention. Accordingly, the drawings and the description are exemplary and not restrictive in nature. In the following text, identical drawing reference labels generally indicate functionally identical or similar elements.

Figure 1:
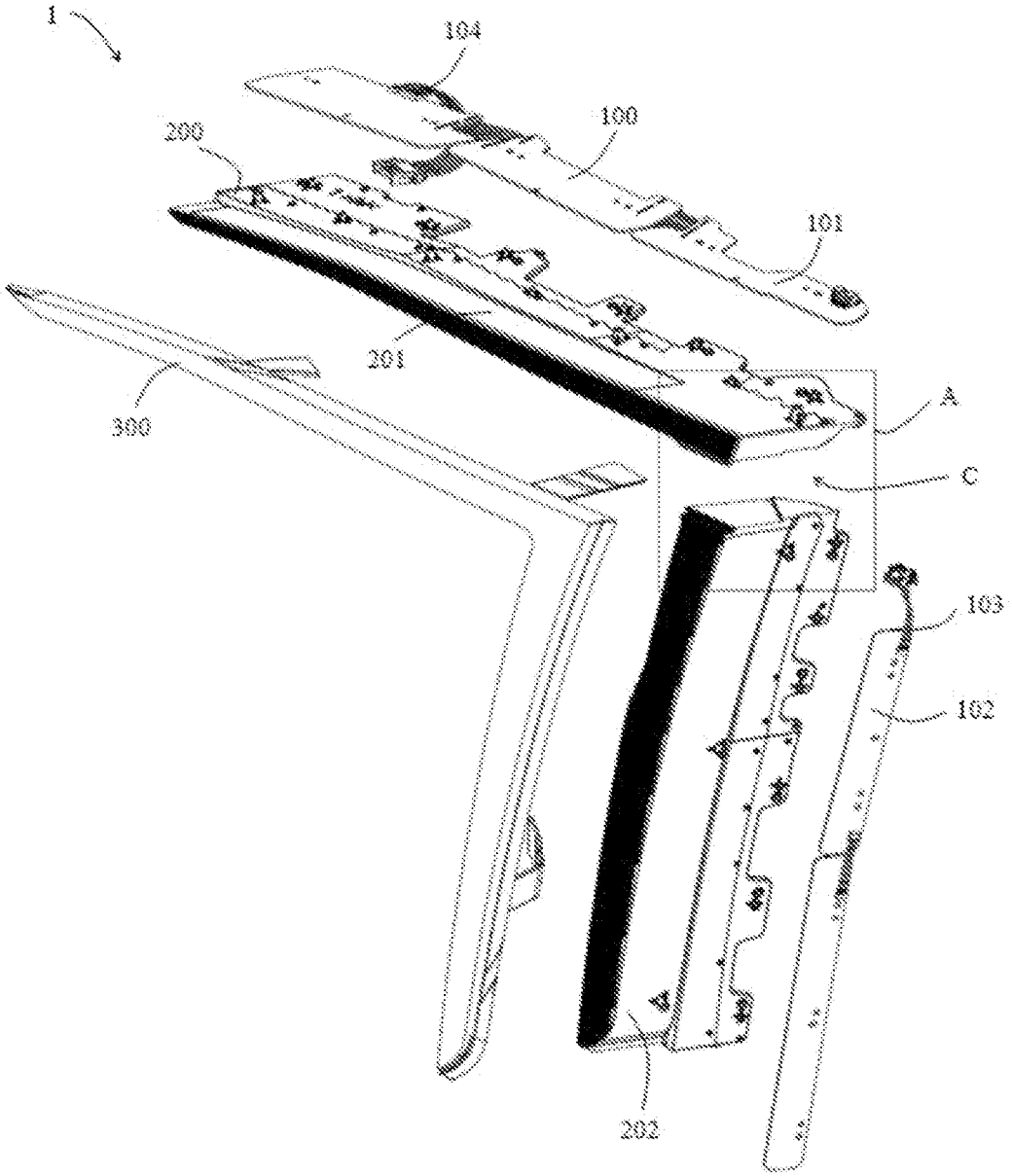
FIG. 1 is a schematic diagram of the vehicle lamp according to the present invention.

FIG. 1 is a schematic diagram of the vehicle lamp 1 according to the present invention. Only the important parts for describing the present invention are shown here, such as the light source component 100, the light guide assembly 200 and the lens 300 of the vehicle lamp, and other parts of the vehicle lamp are omitted, such as the housing and the shell of the vehicle lamp, radiators, etc.

As can be seen in FIG. 1, the light guide assembly of the vehicle lamp 1 comprises two parts, i.e., it is formed by joining or splicing the first light guide element 201 and the second light guide element 202. In the joined state, the two light guide elements form an L shape, and the shape matches that of the lens 300. The light guide assembly will be described in more detail below.

The light guide assembly and the light source component work together. Each light guide element has its own light source. In the illustrated example, the light source component 100 comprises a first light source sub-component 101 and a second light source sub-component 102, which are respectively used for the first light guide element 201 and the second light guide element 202, and their light exit surfaces face the corresponding light incident surfaces 210 and 240 of the light guide elements. The light source sub-component takes the form of a printed circuit board, and different light source sub-components are electrically connected through a conductor 103. A light source assembly of the split plate design is beneficial for reducing the cost, especially when the light guide element is long. Exemplarily, a light source sub-component may be provided with a connector in the form of a male head, the light source sub-component may be provided with a mating connector in the form of a female head, and the two can be connected. The light source component may be electrically connected to the vehicle-mounted power grid through a wire harness 104 for the power supply to the light source component. Of course, each light source sub-component itself may also be in the split plate design, and then electrically connected.

The light source component 100 has a light source, which may be a light-emitting diode 105 disposed on a carrier. The number and color of the light sources may be determined as needed.

In order for the light source component to be correctly positioned and fixed relative to the light guide assembly, the corresponding light guide elements are provided with matching positioning components. As can be seen from FIG. 2, the first light guide element is provided with a positioning pin 214 and a fixing hole 215 for the light source sub-component, and the fixing hole may be a threaded hole. The positioning pin 214 goes through the corresponding positioning hole in the circuit board of the light source sub-component, and the light source sub-component is fixed by a screw screwed into the threaded hole 215. In addition, the first light guide element also has a table 216 to limit the distance between the light source sub-component and the light guide element, preventing damage to related electronic components due to their direct contact. The second light guide element is also provided with a positioning pin 244, a fixing hole 245 and a table 246, with the same functions as those in the first light guide element.

Figure 2:
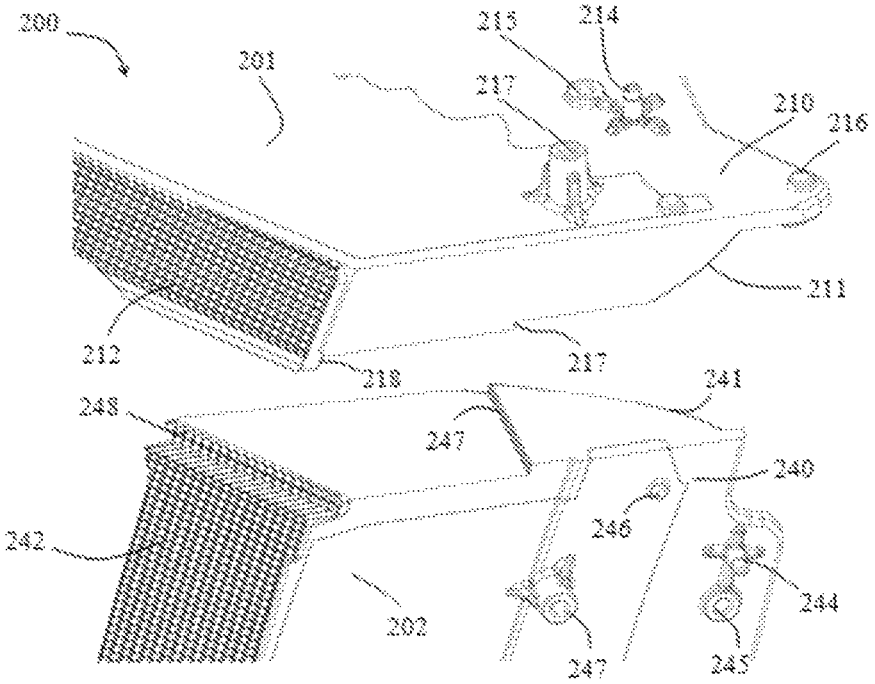
FIG. 2 is a detail view of area A of the vehicle lamp in FIG. 1.

FIG. 2 shows a detail view of the joined region C of the light guide assembly. To show it more clearly, the two light guide elements are spaced apart in the joined region in the figure. It can be seen that the parts of the first light guide element 201 and the second light guide element 202 facing each other have stepped portions.

Figure 3:
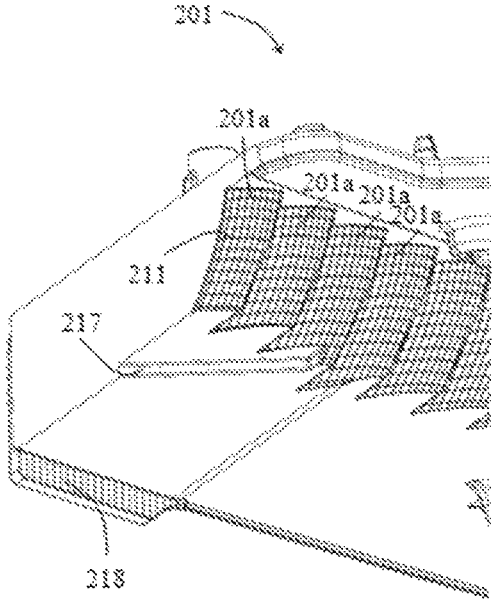
FIG. 3 is a detail view of one light guide element of the light guide assembly used in the vehicle lamp in FIG. 1.

FIG. 3 is a detail view of the first light guide element 201. The first light guide element 201 has two stepped portions 217 and 218 at the end that joins with the second light guide element, which are arranged between the light reflection surface 211 and the light exit surface 212. The first stepped portion 217 and the second stepped portion 218 may extend along different directions. In addition, the step surfaces of the stepped portions 217 and 218 may additionally be optically treated. For example, the stepped portion 218 is designed as a strip array surface.

Figure 4:
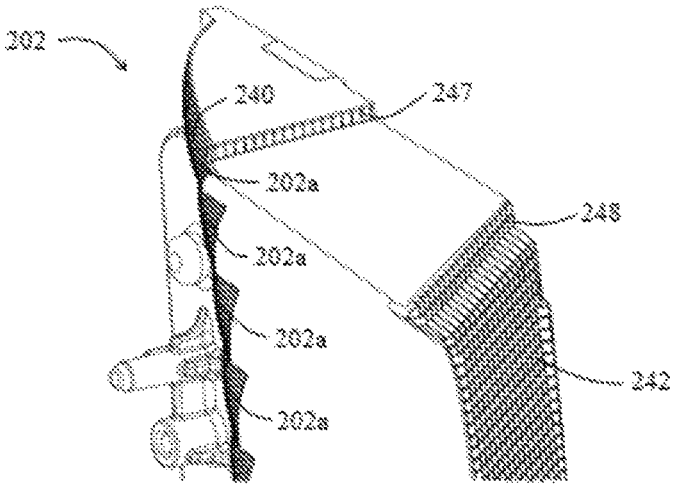
FIG. 4 is a detail view of the other light guide element of the light guide assembly used in the vehicle lamp in FIG. 1.

FIG. 4 is a detail view of the second light guide element 202. The second light guide element 202 also has two stepped portions 247 and 248 at the end that joins with the first light guide element, which are arranged between the light reflection surface 241 and the light exit surface 242. The third stepped portion 247 and the fourth stepped portion 248 may extend along directions matching the first stepped portion 217 and the second stepped portion 218. Here, the surfaces of the stepped portions 247 and 248 in particular facing the stepped portions 217 and 218 are designed as cushion array surfaces.

Figure 5:
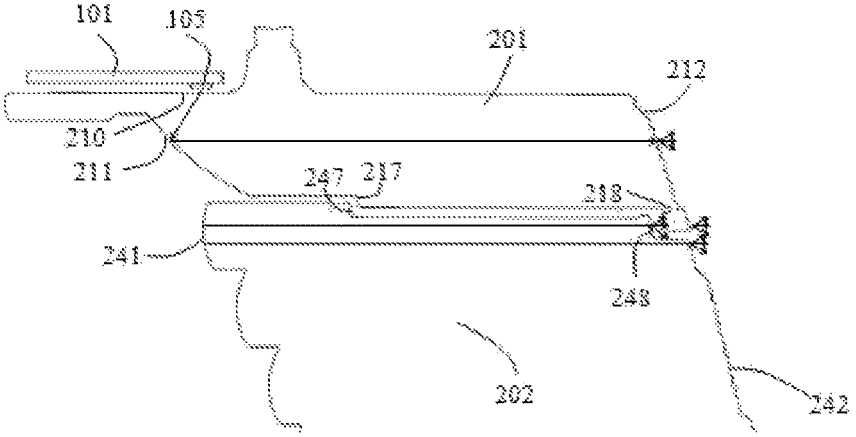
FIG. 5 is a sectional view of the joined region of the light guide assembly used in the vehicle lamp in FIG. 1.
Figure 6:
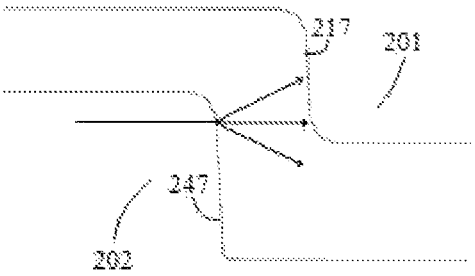
FIG. 6 is a schematic diagram of the light path in the joined region of the light guide assembly.

As can be further seen from FIG. 5 and FIG. 6, in the joined state, the stepped portions 217 and 218 of the first light guide element overlap the stepped portions 247 and 248 of the second light guide element, i.e., the projections of the stepped portions of the two light guide elements at least partially overlap in a plane transverse to the light exit direction, thereby, as can be seen from the light paths in FIG. 5 and FIG. 6, after light propagating in the second light guide element 202 reaches the stepped portion 247, part of it leaves the stepped portion 247 and reaches the stepped portion 217 of the first light guide element 201 before being coupled to the first light guide element, another part of the light can enter the gap that potentially exists between the two light guide elements, and the remaining light can return to the second light guide element after being reflected. The same happens at the stepped portion 248 as that at the stepped portion 247. Through this design, better light mixing at the joined region can be achieved, so as to have an exit light effect that is consistent with other light exit regions as much as possible.

It is to be understood that, although each light guide element is shown as having two stepped portions, the number of stepped portions may be determined as desired.

In addition, it is only exemplary that the stepped portions of the first light guide element are configured to gradually rise along the light exit direction and the stepped portions of the second light guide element are configured to gradually lower along the light exit direction in the drawings. In other embodiments, it is only necessary for the adjacent light guide elements to have overlapping portions in the joined region, so that light leaving one light guide element can at least partially enter the other light guide element. In other words, adjacent light guide elements have complementary shapes in the joined region.

In order to maintain their relative positions, the light guide elements may be fixed on a bracket (not shown). For this purpose, threaded holes 217 and 247 are provided respectively on the light guide elements, so that they can be held on the bracket by screws that are screwed into the threaded holes. The bracket may be the housing or retaining ring of the vehicle lamp or other suitable parts.

Especially for long light guide elements, the light guide element may be divided into a plurality of sections so that a uniform exit light effect can be achieved along the entire length. For example, the first light guide element 201 comprises a plurality of sections 201*a* arranged side by side, the second light guide element 202 comprises a plurality of sections 202*a* arranged side by side, and the sections may be staggered and each may be allocated its own light source, thereby achieving a more flexible design of the light guide elements to better adapt to the internal structural space of the housing of the vehicle lamp.

Preferably, the light reflection surface of each light guide element has the function of alignment, thereby reflecting lighting reaching it as parallel beams as much as possible, thus further facilitating subsequent light distribution.

The light exit surfaces 212 and 242 can be micro-structured, for example, designed to be a cushion-shape array surface, so as to improve the uniformity of exit light.

The light-emitting device in the light source component is preferably a light-emitting diode, and its light color is determined based on the required function. For this purpose, white, red or amber light-emitting diodes may be used. In the case of white light-emitting diodes, their luminous intensity is preferably adjustable, for example, to perform the function of a daytime running light or the position light.

The light guide elements of the light guide assembly are preferably injection molded from a plastic, for example, polycarbonate, polymethyl methacrylate, etc.

It should also be pointed out that the light guide assembly is not limited to having two light guide elements as shown, but may have more light guide elements, as long as the parts of the light guide elements facing each other overlap in the joined region, so that light leaving a light guide element can at least partially enter another light guide element, thereby preventing dark areas at the joined region.

Additionally, in the illustrated vehicle lamp, along the light exit direction, an additional lens 300 may also be disposed before the light guide assembly 200 to further achieve light uniformity.

The present invention is not limited to the structure described above; various other variants could also be used. Although the present invention has already been described by means of a limited number of embodiments, those skilled in the art could, drawing benefit from this disclosure, design other embodiments which do not depart from the scope of protection of the present invention disclosed herein. Thus, the scope of protection of the present invention should be defined by the attached claims alone.

What is claimed is:

1. A light guide assembly of a vehicle headlamp, comprising:

a first light guide and a second light guide that are configured to overlap at a joint region at each respective end of the first and second light guide;

the first and second light guide each having an opposing respective face within a spacing at the joint region;

the first and second light guide joined to form a predetermined shape, wherein the predetermined shape takes an L-form, where the first light guide and the second light guide overlap along stepped portions at the joint region such that light mixing from light sources derived from each light guide is enhanced at the joint region so as to result in a uniformity of light through exit surfaces of the joint region.

2. The light guide assembly as claimed in claim 1, wherein the predetermined shape takes the form of a complex shape alternate to an L-form.

3. The light guide assembly as claimed in claim 1, wherein the first light guide and the second light guide are plate-shape elements with a predetermined thickness.

4. The light guide assembly as claimed in claim 1, wherein the stepped portions of the first light guide overlap the stepped portions of the second light guide in the joined state.

5. The light guide assembly as claimed in claim 1, wherein the first light guide and the second light guide are each divided into a number of sections, each section having its own light coupling surface, light reflection surface and light exit surface, wherein light reaching the light reflection surface is reflected toward the light exit surface, and the light exit surface is provided with micro light diffusion structures.

6. A vehicle lamp, including a light source component, a light guide assembly and a lens, wherein the light source component is assigned to the light guide assembly, and the lens is disposed on the light exit side of the light guide assembly, and with the light guide assembly including at least a first light guide element and a second light guide element, which can be joined to form a predetermined shape, in the region where the first light guide element and the second light guide element are joined, the parts of the first light guide element and the second light guide element that face each other at least partially overlap, so that light leaving one of the first light guide element and the second light guide element can at least partially enter the other.

7. The vehicle lamp as claimed in claim 6, wherein the light source component has a light-emitting diode.

8. A vehicle with at least one vehicle lamp, where each vehicle lamp includes a light source component, a light guide assembly and a lens, wherein the light source component is associated with the light guide assembly, and the lens is-disposed on the light exit side of the light guide assembly;

the light guide assembly including at least a first light guide and a second light guide element that are configured to overlap at a joint region at each respective end of the first and second light guide elements, the first and second light guide elements joined to form a predetermined shape, wherein the predetermined shape takes an L-form;

where the first light guide and the second light guide overlap along stepped portions at the joint region such that light mixing from light sources derived from each light guide is enhanced at the joint region so as to result in a uniformity of light through exit surfaces of the joint region.

9. The vehicle of claim 8, wherein the light source component has a light-emitting diode.

* * * * *